US009533183B1

(12) United States Patent
Khalil

(10) Patent No.: US 9,533,183 B1
(45) Date of Patent: Jan. 3, 2017

(54) ROLLING EXERCISE DEVICE HAVING MODULAR CONSTRUCTION WITH LOW PROFILE

(71) Applicant: Adel Shoukry Khalil, Lake Park, FL (US)

(72) Inventor: Adel Shoukry Khalil, Lake Park, FL (US)

( * ) Notice: Subject to any disclaimer, the term of this patent is extended or adjusted under 35 U.S.C. 154(b) by 0 days.

(21) Appl. No.: 14/077,739

(22) Filed: Nov. 12, 2013

Related U.S. Application Data

(63) Continuation-in-part of application No. 29/417,577, filed on Apr. 5, 2012, now Pat. No. Des. 695,364.

(51) Int. Cl.
*A63B 21/00* (2006.01)
*A63B 22/20* (2006.01)
*A63B 23/12* (2006.01)

(52) U.S. Cl.
CPC ..... *A63B 21/0004* (2013.01); *A63B 22/20* (2013.01); *A63B 23/1236* (2013.01)

(58) Field of Classification Search
CPC ..... A63B 21/0004; A63B 22/20
See application file for complete search history.

(56) References Cited

U.S. PATENT DOCUMENTS 2,817,347 A 12/1957 Hilt, Sr.
3,361,224 A 1/1968 McKim
3,567,242 A 3/1971 Miller
3,584,871 A 6/1971 Kelmon, Jr.
3,664,667 A 5/1972 McCarthy
3,809,393 A 5/1974 Jones
D262,908 S 2/1982 Pesco
D273,042 S 3/1984 Jackson
4,892,305 A 1/1990 Lynch
D333,871 S 3/1993 Grenko
5,222,930 A 6/1993 Bold, Jr.
D346,660 S 5/1994 Chiang
5,632,707 A 5/1997 Daniel et al.
D382,971 S 8/1997 Haldi
D410,549 S 6/1999 Chen
D479,289 S 9/2003 Turner
6,773,379 B1 8/2004 Bing
D502,264 S 2/2005 Timmer
6,942,605 B1 9/2005 Sukhovitsky
D576,693 S 9/2008 Khubani
7,468,025 B2 * 12/2008 Hauser ..... A63B 21/00047 482/141

(Continued)

*Primary Examiner* — Loan H Thanh
*Assistant Examiner* — Megan Anderson
(74) *Attorney, Agent, or Firm* — Glenn E. Gold; Glenn E. Gold, P.A.

(57) ABSTRACT

A rolling exercise device with a low profile includes an elongated handle, a pair of separate support bodies, connections securing the support bodies at their facing inner sides to opposite ends of the handle so as to maintain the support bodies and the handle in a fixed relationship with respect to each other, mounting seats provided beneath each of the support bodies, and rollers rotatably mounted in the mounting seats so as to adapt the support bodies to be freely rolled by the rollers across a support surface as a user gripping the handle supports a portion of his or her weight on the handle. The device has a modular construction in the sense that the support bodies are interchangeable with one another with respect to their relationships to the opposite ends of the handle.

20 Claims, 6 Drawing Sheets

(56) References Cited

U.S. PATENT DOCUMENTS

| | | | | |
|---|---|---|---|---|
| D585,947 | S | 2/2009 | Royster | |
| 7,935,039 | B2 | 5/2011 | Dannenberg | |
| 7,935,040 | B2 | 5/2011 | Moskowich | |
| 7,972,251 | B2 | 7/2011 | Peddar | |
| 7,981,016 | B1 | 7/2011 | Howard | |
| D653,714 | S | 2/2012 | Meininger et al. | |
| D654,544 | S | 2/2012 | Sliemers | |
| D654,545 | S | 2/2012 | Richard | |
| D666,684 | S | 9/2012 | Meininger et al. | |
| D695,364 | S * | 12/2013 | Khalil | D21/662 |
| 8,827,879 | B2 * | 9/2014 | Nicholas | A63B 21/0004 482/131 |
| 8,876,677 | B2 * | 11/2014 | Meininger et al. | 482/132 |
| D739,900 | S * | 9/2015 | Smith | D21/662 |
| 2006/0014615 | A1 * | 1/2006 | Godbold | A63B 21/00047 482/141 |
| 2010/0004105 | A1 | 1/2010 | Peddar | |
| 2010/0130337 | A1 | 5/2010 | Stewart | |
| 2010/0148459 | A1 | 6/2010 | Johnston | |
| 2010/0222180 | A1 | 9/2010 | Takizawa | |
| 2010/0317496 | A1 | 12/2010 | Abranchess | |
| 2012/0238420 | A1 | 9/2012 | Meininger et al. | |
| 2013/0217549 | A1 | 8/2013 | Marji | |
| 2014/0018217 | A1 * | 1/2014 | Brown | A63B 22/20 482/132 |
| 2014/0371040 | A1 * | 12/2014 | Vasquez | A63B 1/00 482/132 |

* cited by examiner

ROLLING EXERCISE DEVICE HAVING MODULAR CONSTRUCTION WITH LOW PROFILE

CROSS REFERENCE(S) TO RELATED APPLICATION(S)

This non-provisional U.S. patent application claims the benefit of U.S. Design patent application Ser. No. 29/417,577, filed Apr. 5, 2012, which is hereby incorporated in its entirety herein by reference thereto.

FIELD OF THE INVENTION

The present invention generally relates to exercise devices and, more particularly, is concerned with a rolling exercise device having a modular construction with a low profile.

BACKGROUND OF THE INVENTION

Many exercise devices are known in the prior art. There are specific ones designed to assist users in performance of upper body exercises on support surfaces, such as a floor. These devices have several different designs.

One prior art design, disclosed in U.S. Pat. No. 6,773,379, U.S. Pat. App. Pub. No. 2012/0238420, and U.S. Des. Pat. Nos. D653,714, D654,544 and D666,684, employs a solid base, a plurality of rollers, balls or wheels rotatably mounted to and extending below a bottom side of the solid base so as to movably support the base on the support surface, and a handle affixed on and extending above an upper side of the solid base such that the gripping portion of the handle is spaced above the solid base where it can be gripped by a user to guide the movable base across the support surface. One potential drawback of this design might be that the weight of the solid base could be excessive such that it tends to increase the resistance or drag of the device thus impeding it from moving freely across the support surface. Another potential drawback might be the height of the handle above the floor could be excessive due to its mounting arrangement which necessarily spaces it above the solid base in order to allow for insertion of fingers about the handle in order to grip it. The excessive height of the handle might cause tilting of the device from skewing or bias the force applied by the user more toward one set of the balls, rollers or wheels than the other during performance of exercises so as to further increase the resistance or drag of the device to moving freely across the surface.

Another prior art design, disclosed in U.S. Pat. No. 3,809,393, employs separate plate-like support members at opposite ends of a handle that are in turn supported by swivel casters. The provision of separate support members might reduce at least a portion of the excessive weight of a solid base as used in the prior art design discussed above. However, the employment of swivel casters might be a potential drawback that offsets the benefit from any weight savings in that the swivel casters might increase the resistance or drag of the device to moving freely across the surface. Also, another potential drawback might be the techniques of construction utilized in making the device of the cited patent. In one embodiment, the opposite end portions of the handle are rabbeted or notched in order to form joints between the handle and the separate support members. In the other embodiment, bores that receive the opposite end portions of the handle are formed completely through the middle of the separate support members in order to form joints between the handle and separate support members. These techniques of construction might result in weakening the structural integrity of either the handle or support members when the device is called on to support the upper body weight of the user during use of the device.

Accordingly, there remains a need for an innovation that will overcome these potential drawbacks of the known prior art and any problems that remain unsolved.

SUMMARY OF THE INVENTION

The present invention overcomes the potential drawbacks of the known prior art and any problems that remain unsolved by providing a rolling exercise device having a modular construction and with a low profile relative to a surface supporting the device. The modular construction of the rolling exercise device reduces its overall height and weight, facilitates ease of manufacture and assembly of the device, and augments its structural integrity during use. The low profile of the rolling exercise device together with its reduced height and weight and augmented structural integrity enhance its stability in supporting the weight of the upper body of a user and minimizes its resistance or drag, and thus maximizes its glide capability such that as the user manually grips the device and performs exercises using upper body muscles the device can move more freely in any direction on the supporting surface.

In one aspect of the present invention, a rolling exercise device includes:

- an elongated handle having opposite ends and a grip portion between the opposite ends;
- a pair of separate support bodies each including
  - opposite end portions,
  - a middle portion extending between and merging into the opposite end portions,
  - opposite bottom and top sides,
  - opposite inner and outer sides, each of the support bodies having a width extending between the opposite inner and outer sides,
  - a cavity recessed into the middle portion of each support body at the inner side thereof to a depth less than the width of the middle portion, the cavity being located between and spaced from the bottom and top sides of support body and being configured to receive one of the opposite ends of the handle so as to provide a snug fitting relationship between the support bodies and the elongated handle, and
  - mounting seats provided on and extending below the opposite end portions at the bottom sides of the support bodies;
- connections provided respectively in and extending between the ends of the handle and the middle portions of the support bodies so as to retain the support bodies and the elongated handle in a secured snug fitting fixed relationship with respect to each other; and
- rollers rotatably mounted in the mounting seats of the support bodies so as to adapt the support bodies to be rolled by the rollers across a support surface as a user gripping the handle performs exercises and supports a portion of the body weight of the user on the handle.

In another aspect of the present invention, a rolling exercise device includes:

- an elongated handle having opposite ends and a grip portion extending between the opposite ends, said handle having a cylindrical cross-sectional configuration;
- a pair of separate support bodies each including
  - opposite end portions, middle portion extending between and merging into the opposite end portions, opposite inner and outer sides, each of the support bodies having a width extending between the opposite inner and outer sides, the width of each of the support bodies at the middle portion being substantially the same as at the opposite end portions, opposite bottom and top sides, each of the support bodies also having a height extending between the bottom and top sides that is at a maximum at the middle portion and decreases to a minimum at opposite ends of the each support body on the opposite end portions, and a cavity having a cylindrical configuration being recessed into the middle portion of each of the support bodies at the inner sides thereof to a depth less than the width of the middle portion, the cavity being located between and spaced from the bottom and top sides of the support body and being configured to receive one of the opposite ends of the cylindrical handle so as to provide a snug fitting relationship between the support bodies and the elongated handle;

a mounting seats provided on and extending below the opposite end portions at the bottom sides of the support bodies;

connections provided respectively in and extending between the ends of the handle and the middle portions of the support bodies so as to retain the support bodies and the elongated handle in a secured snug fitting fixed relationship with respect to each other, the connections including first bores threadably formed in at least opposite end portions of the handle so as to extend through the opposite ends of said handle, second bores formed in the middle portions of the support bodies so as to extend between the recessed cavities and the outer sides of the support bodies and align with the first bores of the handle, and fasteners configured to insert through the second bores of the support bodies and thread into the first bores of the handle so as to securely connect the handle to the support bodies; and rollers rotatably mounted in the mounting seats of the support bodies so as to adapt the support bodies to be freely rolled by the rollers across a support surface as a user gripping the handle performs exercises and supports a portion of the body weight of the user on the handle.

In still another aspect of the present invention, a rolling exercise device includes:

an elongated handle having opposite ends and a grip portion extending between the opposite ends, said handle having a cylindrical cross-sectional configuration;

a pair of separate support bodies each including opposite end portions, a middle portion extending between and merging into the opposite end portions, opposite inner and outer sides, each of the support bodies having a width extending between the opposite inner and outer sides, the width of each of the support bodies at the middle portion is substantially the same as at the opposite end portions, opposite bottom and top sides, each of the support bodies also having a height extending between the bottom and top sides that is at a maximum at the middle portion and decreases to a minimum at opposite ends of each support body on the opposite end portions, and a cavity having a cylindrical configuration being recessed into the middle portion of each of the support bodies at the inner sides thereof to a depth less than the width of the middle portion, the cavity being located between and spaced from the bottom and top sides of the support body and being configured to receive one of the opposite ends of the cylindrical handle so as to provide a snug fitting relationship between the support bodies and the elongated handle;

mounting seats provided on and extending below the opposite end portions at the bottom sides of the support bodies, the mounting seats include:

sockets affixed on and extending below the bottom side of each of the support bodies at the opposite end portions thereof, each socket having a hollow cylindrical configuration and a lower open end, and sleeves having spherical configurations with opposite top and bottom truncated ends, the sleeves having outside diameters matched with inside diameters of the sockets such that each of the sleeves snugly fits through the lower open end and into one of the sockets and contacts at the top truncated end of the sleeve with the bottom side of each of the support bodies at each of the opposite end portions thereof;

connections provided respectively in and extending between the ends of the handle and the middle portions of the support bodies so as to retain the support bodies and the elongated handle in a secured snug fitting fixed relationship with respect to each other, the connections including first bores threadably formed in at least opposite end portions of the handle so as to extend through the opposite ends of the handle, second bores formed in the middle portions of the support bodies so as to extend between the recessed cavities and the outer sides of the support bodies and align with the first bores of the handle, and fasteners configured to insert through the second bores of the support bodies and thread into the first bores of the handle so as to securely connect the handle to the support bodies; and rollers each having an outside diameter matching an inside diameter of one of the sleeves such that each roller snugly fits with one of the sleeves, the bottom side of each of the support bodies at each of the opposite end portions thereof has a concave depression defined thereon being centered relative to one of the sockets and with a portion of one of the rollers protruding from the top truncated end of the sleeve also protruding into the respective concave depression, the sleeves having substantially frictionless inside surfaces and protrude from the lower open ends of the sockets with the rollers protruding from the bottom truncated ends of the sleeves so as to enable free wheeling rotation of the rollers in the sleeves and in contact with the support surface, thereby adapting the support bodies to be freely rolled by the rollers across a support surface as a user gripping the handle performs exercises and supports a portion of the body weight of the user on the handle.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
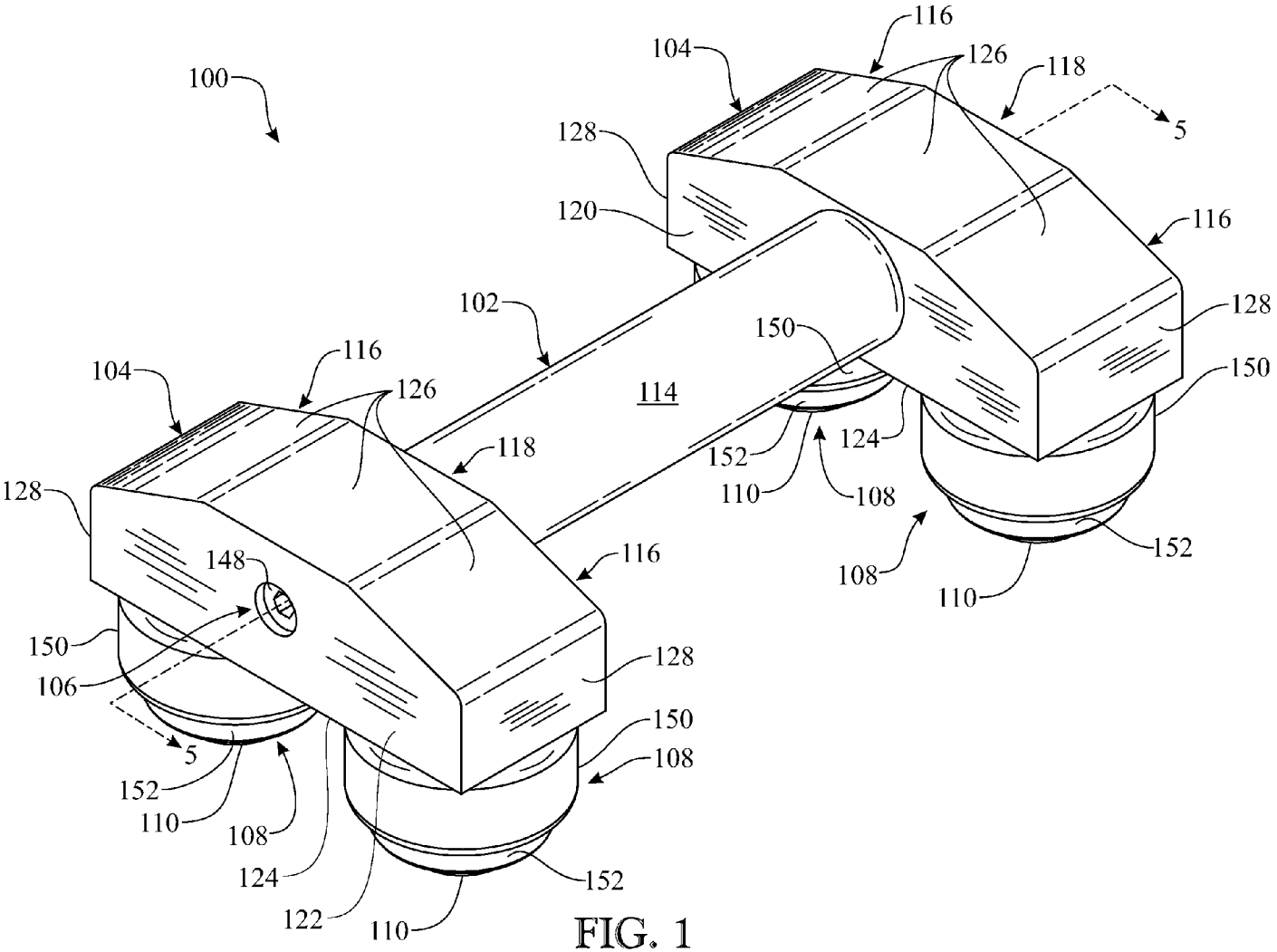
FIG. 1 presents a top isometric view of an exemplary embodiment of a low profile rolling exercise device in accordance with the present invention, the view showing the device in a fully assembled form.
Figure 2:
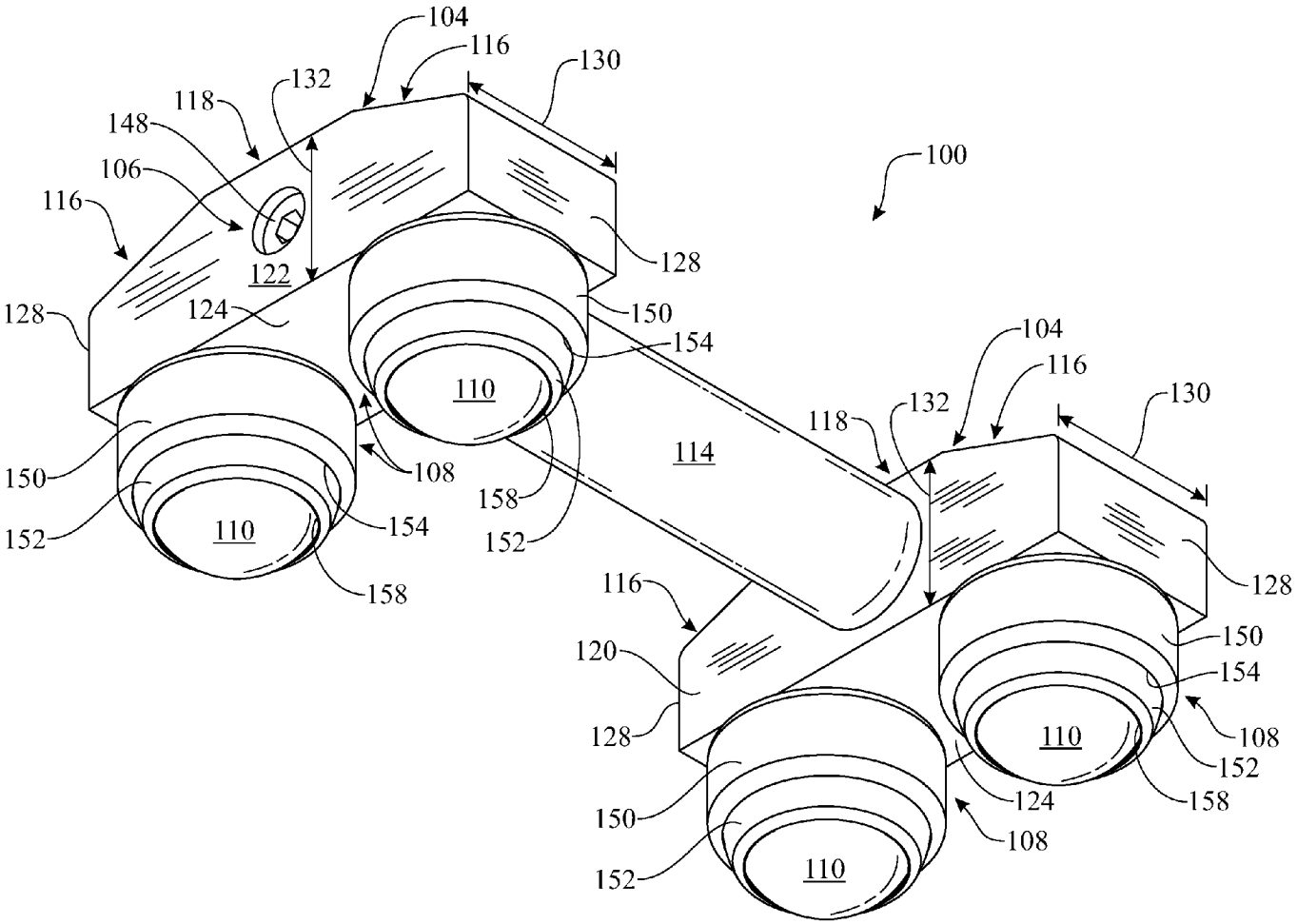
FIG. 2 presents a bottom isometric view of the device.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "bottom", "top", "inside", "outside", "end", and derivatives thereof shall relate to the invention as oriented in FIGS. 1 and 2. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-6, there is illustrated an exemplary embodiment of a rolling exercise device, generally designated 100, having a modular construction and a low profile in accordance with the present invention. The device 100 basically includes an elongated handle 102, a pair of support bodies 104 each being a single unit separate from, but substantially identical to, one another, and connections 106 securing the support bodies 104 to the opposite ends of the handle 102 in a fixed relationship with respect to each other such that only the elongated handle 102 extends between and interconnects the two single units. Each of the support bodies 104 includes a beam 107 and a pair of mounting seats 108 provided beneath the beam 107 of each of the support bodies 104. Each of the support bodies 104 also includes a pair of rollers 110 rotatably mounted in the mounting seats 108 so as to adapt the support bodies 104 to be freely rolled by the rollers 110 across a support surface or floor as a user gripping the handle 102 supports his or her weight on the handle. A modular construction is provided in the sense that the support bodies 104 are mirror images of each other and thus are interchangeable with one another with respect to their positional relationships at the opposite ends of the handle 102. Furthermore, the beams 107 of the support bodies 104, which may be solid structures, span over and are supported by the mounting seats 108 and rollers 110 of the support bodies 104 so as to provide the overall device 100 with a relatively low profile. The components of the device 100 may be made by application of well-known fabrication techniques using various materials, such as metals or plastics.

As best seen in FIGS. 1-5, the elongated handle 102 has opposite ends 112 and a grip portion 114 extending between and merging with the opposite ends 112. The handle 102 also has a uniform cylindrical cross-sectional configuration from end to end and a longitudinal axis 115 extending lengthwise of the handle 102 through the opposite ends 112 and the grip portion 114. Alternatively, the handle 102 may have other suitable cross-sectional configurations.

Referring again to FIGS. 1-6, each of the support bodies 104 includes opposite end portions 116 and a middle portion 118 extending between and merging into the opposite end portions 116. The opposite end portions 116 are mirror images of, and substantially identical to, one another. Each of the support bodies 104 also includes opposite inner and outer sides 120, 122, opposite bottom and top sides 124, 126, and opposite ends 128. Each of the support bodies 104 further has a width 130 extending between the opposite inner and outer sides 120, 122. The width 130 of each of the support bodies 104 at the middle portion 118 is substantially the same as at the opposite end portions 116. Each of the support bodies 104 also has a height 132 extending between the bottom and top sides 124, 126 that, as can be readily seen in FIG. 6, is at a maximum at the middle portion 118 and decreases by tapering down to a minimum at opposite ends 128 of the support body 104 on the opposite end portions 116.

Figure 3:
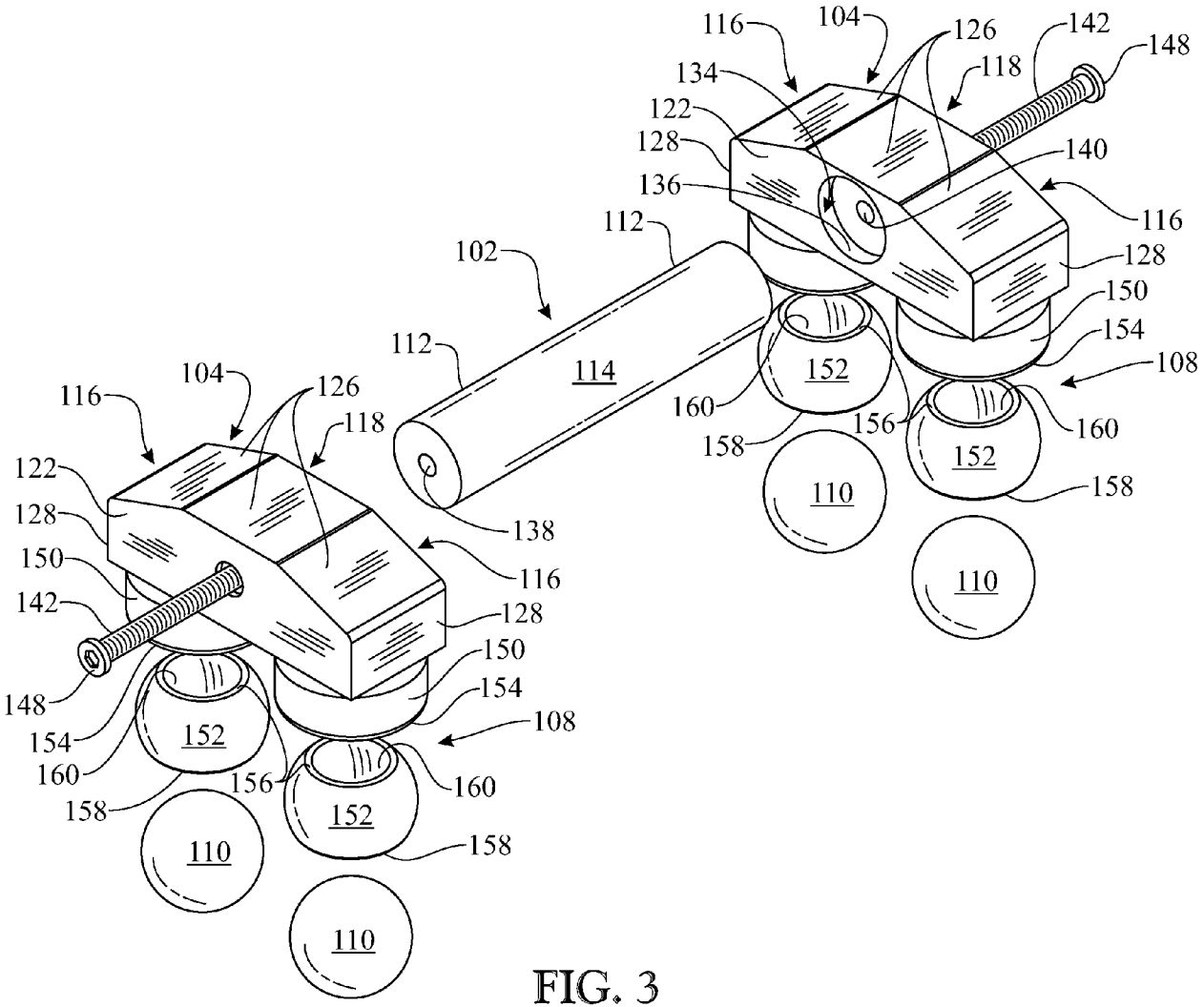
FIG. 3 presents a top isometric view of the device, the view showing the device in an exploded form and on a reduced scale compared to that of FIGS. 1 and 2.
Figure 4:
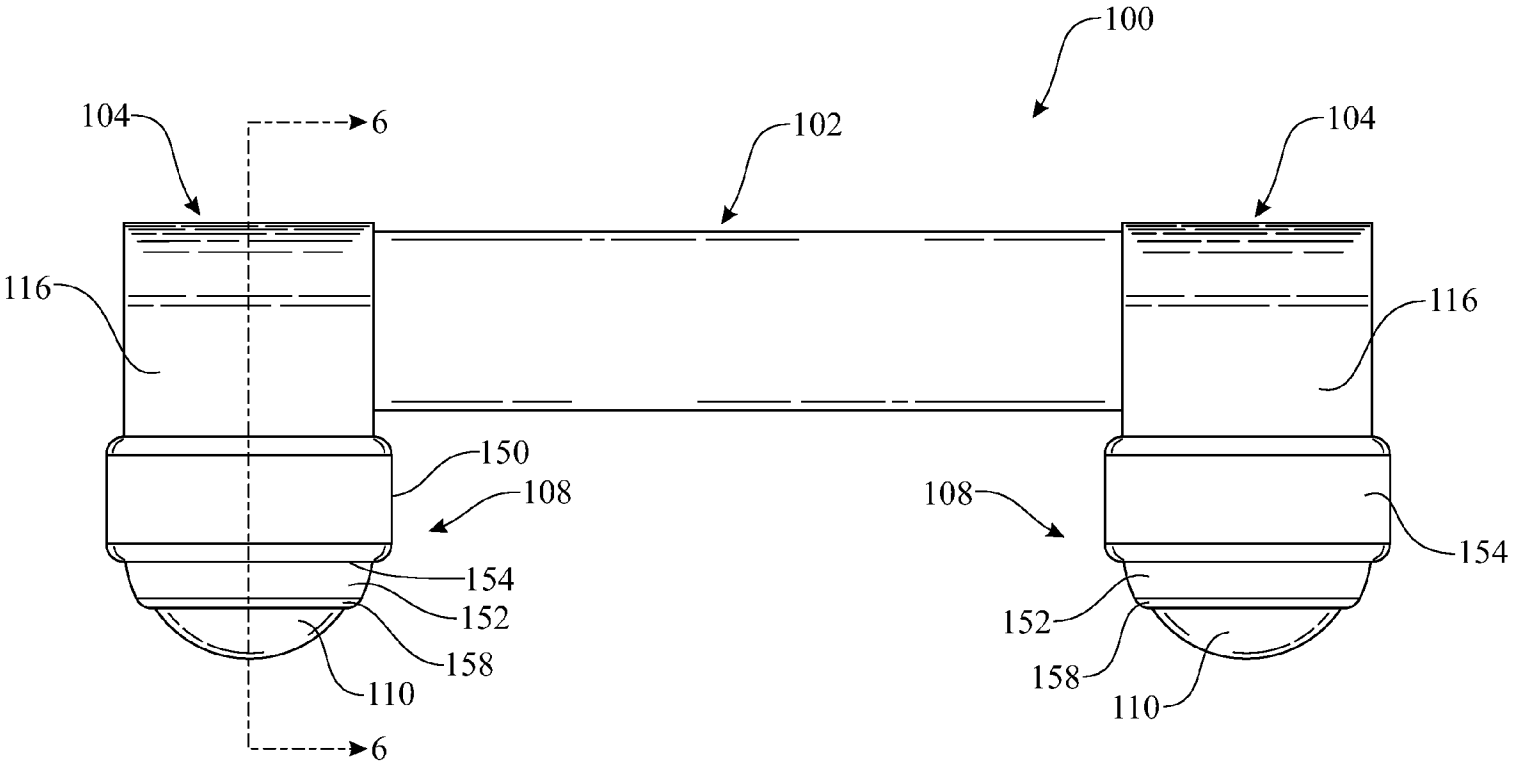
FIG. 4 presents a side elevation view of the device of FIGS. 1 and 2.
Figure 5:
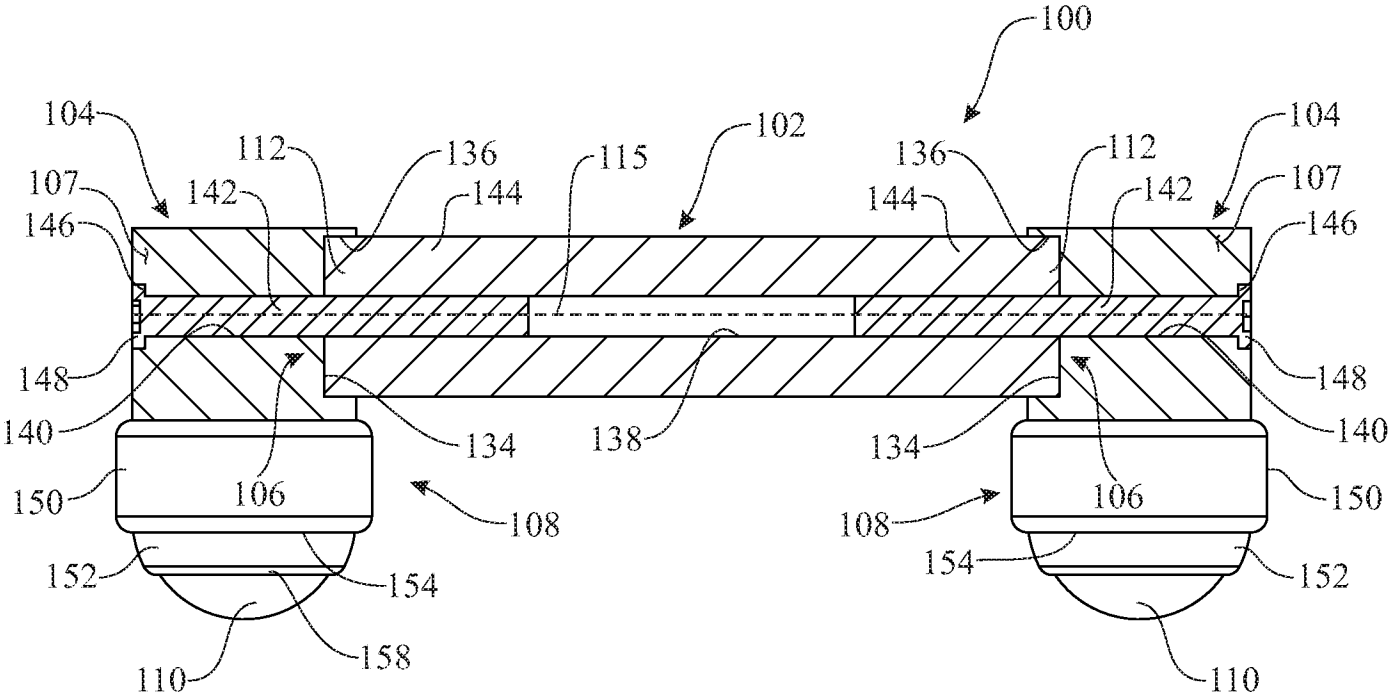
FIG. 5 presents a longitudinal sectional view of the device taken along line 5-5 of FIG. 1, the view showing the device on a slightly reduced scale compared to that of FIG. 1.
Figure 6:
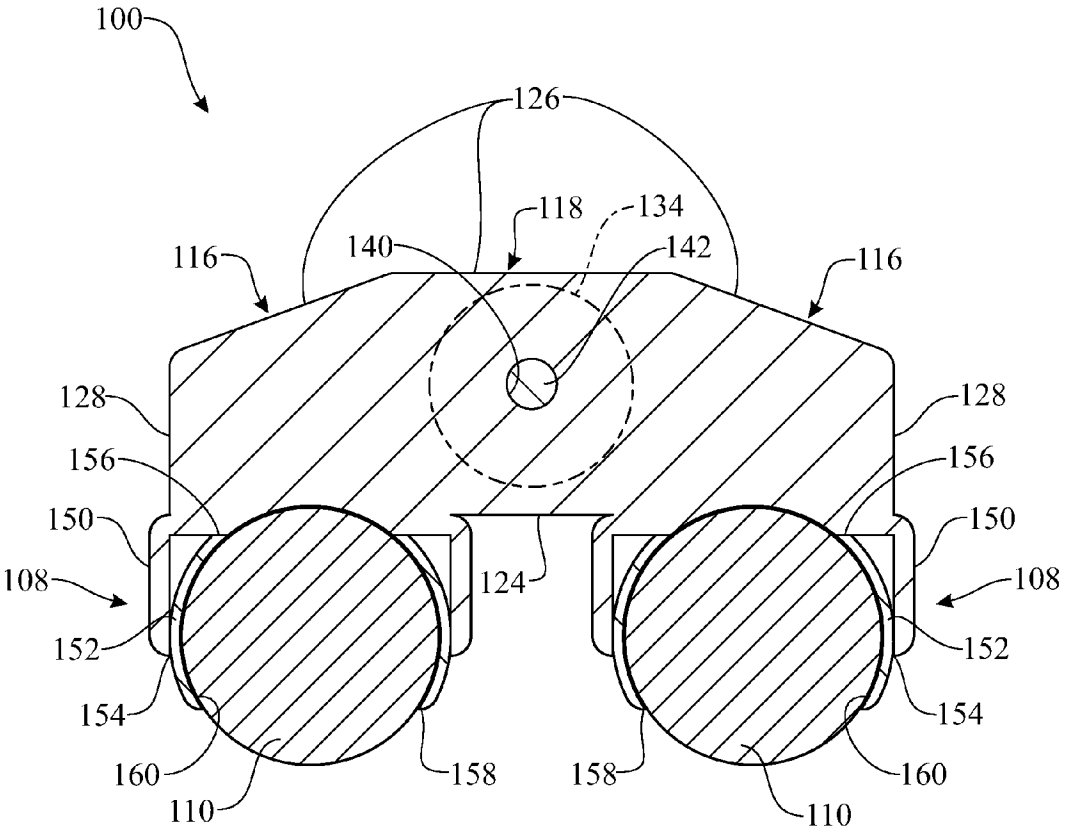
FIG. 6 presents a transverse sectional view of the device taken along line 6-6 of FIG. 4, the view showing the device on an enlarged scale compared to that of FIG. 4.

As best seen in FIGS. 3, 5 and 6, each of the support bodies 104 also has a cavity 134 of a cylindrical configuration and being recessed into the middle portion 118 of each of the support bodies 104 at the inner side 120 thereof to a depth 136 less than the width 130 of the middle portion 118. By way of example, but not of limitation, the depth 136 may be about fifteen percent of the width 130. The cavity 134 is located between and spaced from the bottom and top sides 124, 126 of the support body 104. Being of cylindrical configuration, the cavity 130 is thereby configured to receive one of the opposite ends 112 of the cylindrical handle 102 so as together with the connections 106 provide a snug fitting fixed relationship between the support bodies 104 and the elongated handle 102.

As best seen in FIGS. 3 and 5, the connections 106 that secure the support bodies 104 to the handle 102 in the fixed relationship with respect to each other are provided respectively in and extend between the opposite ends 112 of the handle 102 and the middle portions 118 of the support bodies 104 and in coaxial alignment with the longitudinal axis 115 of the handle so as to retain the support bodies 104 and elongated handle 102 in a secured snug fitting fixed relationship with respect to each other. More particularly, the connections 106 including first bores 138, second bores 140, and threaded fasteners 142. The first bores 138 are respectively threadably formed in at least opposite end portions 144 of the handle 102 so as to extend through the opposite ends 112 of the handle 102 in coaxial alignment with the longitudinal axis 115 thereof. The second bores 140 are respectively formed in the middle portions 118 of the support bodies 102 so as to extend between the recessed cavities 134 and the outer sides 122 of the support bodies 102 and align with the first bores 138 of the handle 102 and in coaxial alignment with the longitudinal axis 115 of the handle. The threaded fasteners 142 are inserted through the second bores 140 of the support bodies 102 and threaded into the first bores 138 of the handle 102 in coaxial alignment with the longitudinal axis 115 of the handle so as to securely connect the handle 102 to the support bodies 104 in a fixed relationship with each other, thereby providing the device 100 with a rigid structural framework.

More specifically, by way of example, but not of limitation, the first bores 138 may be threadably formed completely through the handle 102 from one of the opposite ends 112 to the other of the opposite ends 112. Also, the support bodies 104 have countersunk rims 146 recessed into the outer sides 122 of the support bodies 102 and extending about the second bores 140 such that enlarged heads 148 on the fasteners 142 abut against the countersunk rims 146 when the fasteners 142 are threaded sufficiently into the first bores 138 of the handle 102 to securely connect the handle 102 to the support bodies 104.

As mentioned above and seen in FIGS. 1-6, the mounting seats 108 are provided on and extend below the bottom sides 124 of the beams 107 of the support bodies 104 at their outer end portions 116. For example, there are two mounting seats 108 below the beam 107 of each of the support bodies 104 with each mounting seat 108 being below a respective one of the opposite end portions 116 of the beam 107. More particularly, as best seen in FIGS. 3 and 6, the mounting seats 108 include respective sockets 150 and sleeves 152. Each socket 150 has a hollow cylindrical configuration and a lower open end 154. The sockets 150 may be affixed on and extend below the bottom side 124 of the beam 107 of each of the support bodies 104 at the opposite end portions 116 thereof such that each of the support bodies 104 forms the single unit, as shown in FIG. 6, in which the beam structure 107 and the two mounting seats 108 are integrally formed with one another. Alternatively, the two mounting seats 108 of each of the support bodies 104 may be separate and independent components from the beam 107 of each of the support bodies 104 that are fastened to the beam 107 to form the single unit therewith. Thus, each of the support bodies 104 forms a single unit that is separate and independent from one another such that only the elongated handle 102 extends between and interconnects the two single units.

Each of the sleeves 152 has a spherical configuration with opposite top and bottom truncated ends 156, 158. The sleeves 152 have outside diameters matching the inside diameters of the sockets 150 such that each of the sleeves 152 snugly fits through the lower open end 154 and into a respective one of the sockets 150. The sleeve 152 at its top truncated end 156 is brought into contact with the bottom side 124 of the respective support body 104 at the respective opposite end portion 116 thereof. Furthermore, the bottom side 124 of each of the support bodies 104 at each of the opposite end portions 116 thereof has a concave depression 158 defined thereon being centered relative to one of the sockets 150.

As best seen in FIG. 6, each of the rollers 110 has an outside diameter matching an inside diameter of a respective one of the sleeves 152 such that each roller 110 snugly fits with the one sleeve 152, and with a portion of the roller 110 protruding from the top truncated end 156 of the sleeve 152 also protruding into the respective concave depression 158. The sleeves 152 have substantially frictionless inside surfaces 160 and protrude from the lower open ends 154 of the sockets 152 with the rollers 110 protruding from the bottom truncated ends 158 of the sleeves 152 so as to enable free wheeling rotation of the rollers 110 in the sleeves 152 and in contact with the support surface. In such manner, the support bodies 104 are adapted to be freely rolled by the rollers 110 across the support surface as a user gripping the handle 102 performs exercises and supports a portion of his or her body weight on the handle 102.

In summary, the above-described components of the rolling exercise device 100 provide it with a modular construction and a low profile that reduces its overall height and weight, facilitates its ease of manufacture and assembly, and augments its structural integrity during use.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A rolling exercise device, comprising:

an elongated handle having opposite ends and a grip portion extending between said opposite ends, said elongated handle also having a longitudinal axis extending lengthwise of said elongated handle through said opposite ends and said grip portion thereof;

a pair of support bodies each being a single unit separate and independent from one another; and connections securing said support bodies to said opposite ends of said elongated handle in a fixed relationship with respect to each other such that only said elongated handle extends between and interconnects said two support bodies;

wherein each of said support bodies comprises a beam having opposite end portions, a middle portion extending between and merging into said opposite end portions, opposite bottom and top sides, and opposite inner and outer sides, with said beam having a width extending between said opposite inner and outer sides, a cavity recessed into said middle portion of said beam from said inner side thereof to a depth less than said width of said beam, said cavity being located between and spaced from said bottom and top sides of said beam and being configured to receive one of said opposite ends of said elongated handle so as to provide a snug fitting relationship between said elongated handle and said beam of each of said support bodies, mounting seats provided on and extending below said respective opposite end portions at said bottom side of said beam of each of said support bodies, and rollers rotatably mounted in said mounting seats so as to adapt said support bodies to be freely rolled by said rollers across a support surface as a user gripping said elongated handle performs exercises and supports a portion of a body weight of the user on said elongated handle;

also wherein said connections comprise threaded fasteners and are provided respectively in and extend between said opposite ends of said elongated handle and said middle portion of said beam of each of said support bodies in coaxial alignment with said longitudinal axis of said elongated handle so as to retain said elongated handle and said beam of each of said support bodies in said secured snug fitting fixed relationship with respect to each other.

2. The device of claim 1 wherein said mounting seats comprise:

sockets affixed on and extending below said bottom side of said beam of each of said support bodies at said opposite end portions thereof, each of said sockets having a hollow cylindrical configuration and a lower open end; and sleeves having spherical configurations with opposite top and bottom truncated ends, said sleeves having outside diameters matched with inside diameters of said sockets such that each sleeve snugly fits through said lower open end and into one of said sockets, said sleeves having inside diameters match with outside diameters of said rollers such that each of said rollers snugly fits with one of said sleeves, said sleeves having substantially frictionless inside surfaces so as to allow free wheeling rotation of said rollers in said sleeves and thereby said support bodies to be freely rolled by said rollers across the support surface.

3. The device of claim 2 wherein said sleeves adjacent said bottom truncated ends thereof respectively protrude from said lower open ends of said sockets with a portion of a respective one of said rollers protruding from said bottom truncated end of each said sleeve.

4. The device of claim 2 wherein said sleeves at said top truncated ends respectively contact said bottom side of said beam of each of said support bodies at each of said opposite end portions thereof.

5. The device of claim 2 wherein said bottom side of said beam of each of said support bodies at each of said opposite end portions thereof has a concave depression defined thereon being centered relative to a respective one of said sockets and with a portion of a respective one of said rollers protruding from said top truncated end of said sleeve also protruding into said respective concave depression.

6. The device of claim 1 wherein said connections comprises:

first bores threadably formed in at least opposite end portions of said elongated handle so as to extend through said opposite ends of said elongated handle in coaxial alignment with said longitudinal axis of said elongated handle;

second bores formed in said middle portions of said beams of said support bodies so as to extend between said recessed cavities and said outer sides of said beams of said support bodies and align with said first bores of said elongated handle in coaxial alignment with said longitudinal axis of said elongated handle; and the threaded fasteners inserted through said second bores of said beams of said support bodies and threaded into said first bores of said elongated handle in coaxial alignment with said longitudinal axis of said elongated handle so as to securely connect said elongated handle to said beams of said support bodies.

7. The device of claim 6 wherein said first bores are threadably formed completely through said elongated handle from one of said opposite ends to the other of said opposite ends.

8. The device of claim 6 wherein said beams of said support bodies have countersunk rims recessed into said outer sides thereof and extending about said second bores such that enlarged heads on said fasteners abut against said countersunk rims when said fasteners are threaded sufficiently into said first bores of said elongated handle to securely connect said elongated handle to said beams of said support bodies.

9. The device of claim 1 wherein said beam of each of said support bodies has a height extending between said bottom and top sides that is at a maximum at said middle portion and decreases to a minimum at opposite ends of said beam on said opposite end portions.

10. The device of claim 9 wherein said cavity recessed into said middle portion of said beam of each of said support bodies at said inner side thereof has a maximum dimension less than said maximum height and greater than said minimum height of said beam.

11. The device of claim 1 wherein said elongated handle has a cylindrical cross-sectional configuration from end to end.

12. The device of claim 11 wherein said cavity recessed into said middle portion at said inner side of said beam of each of said support bodies has a cylindrical configuration.

13. The device of claim 1 wherein said support bodies are interchangeable with one another with respect to their relationships to said opposite ends of said elongated handle.

14. The device of claim 1 wherein said width of said beam of each of said support bodies at said middle portion is substantially the same as at said opposite end portions.

15. A rolling exercise device, comprising:

an elongated handle having opposite ends and a grip portion extending between said opposite ends, said elongated handle also having a cylindrical cross-sectional configuration and a longitudinal axis extending lengthwise of said elongated handle through said opposite ends and said grip portion thereof;

a pair of support bodies each being a single unit separate and independent from one another; and connections securing said support bodies to said opposite ends of said elongated handle in a fixed relationship with respect to each other such that only said elongated handle extends between and interconnects said two support bodies;

wherein each of said support bodies comprises a beam having opposite end portions, a middle portion extending between and merging into said opposite end portions, opposite inner and outer sides with said beam having a width extending between said opposite inner and outer sides and being substantially the same at said middle portion as at said opposite end portions, and opposite bottom and top sides with said beam also having a height extending between said bottom and top sides that is at a maximum at said middle portion and decreases to a minimum at opposite ends of said beam on said opposite end portions, a cavity having a cylindrical configuration being recessed into said middle portion of said beam at said inner side thereof to a depth less than said width of said middle portion, said cavity being located between and spaced from said bottom and top sides of said beam and being configured to receive one of said opposite ends of said elongated handle so as to provide a snug fitting relationship between said elongated handle and said beam of each of said support bodies, mounting seats provided on and extending below said respective opposite end portions at said bottom side of said beam of each of said support bodies, and rollers rotatably mounted in said mounting seats so as to adapt said support bodies to be freely rolled by said rollers across a support surface as a user gripping said elongated handle performs exercises and supports a portion of a body weight of the user on said elongated handle;

also wherein said connections are provided respectively in and extending between said opposite ends of said elongated handle and said middle portion of said beam of each of said support bodies so as to retain said elongated handle and said beam of each of said support bodies in said secured snug fitting fixed relationship with respect to each other, said connections comprising first bores threadably formed in at least opposite end portions of said elongated handle so as to extend through said opposite ends of said elongated handle in coaxial alignment with said longitudinal axis of said elongated handle, second bores formed in said middle portions of said beams of said support bodies so as to extend between said recessed cavities and said outer sides of said beams of said support bodies and align with said first bores of said elongated handle in coaxial alignment with said longitudinal axis of said elongated handle, and fasteners inserted through said second bores of said beams of said support bodies and threaded into said first bores of said elongated handle in coaxial alignment with said longitudinal axis of said elongated handle so as to securely connect said elongated handle to said beams of said support bodies.

16. The device of claim 15 wherein said support bodies are interchangeable with one another with respect to their relationships to said opposite ends of said elongated handle.

17. The device of claim 15 wherein said first bores are threadably formed completely through said elongated handle from one of said opposite ends to the other of said opposite ends.

18. The device of claim 15 wherein said beams of said support bodies have countersunk rims recessed into said outer sides thereof and extending about said second bores such that enlarged heads on said fasteners abut against said countersunk rims when said fasteners are threaded sufficiently into said first bores of said elongated handle to securely connect said elongated handle to said support bodies.

19. A rolling exercise device, comprising:

an elongated handle having opposite ends and a grip portion extending between said opposite ends, said elongated handle also having a cylindrical cross-sectional configuration and a longitudinal axis extending lengthwise of said elongated handle through said opposite ends and said grip portion thereof;

a pair of support bodies each being a single unit separate and independent from one another; and connections securing said support bodies to said opposite ends of said elongated handle in a fixed relationship with respect to each other such that only said elongated handle extends between and interconnects said two support bodies;

wherein each of said support bodies comprises a beam having opposite end portions, a middle portion extending between and merging into said opposite end portions, opposite inner and outer sides with said beam having a width extending between said opposite inner and outer sides and being substantially the same at said middle portion as at said opposite end portions, and opposite bottom and top sides with said beam also having a height extending between said bottom and top sides that is at a maximum at said middle portion and decreases to a minimum at opposite ends of said beam on said opposite end portions, a cavity having a cylindrical configuration being recessed into said middle portion of said beam at said inner side thereof to a depth less than said width of said middle portion, said cavity being located between and spaced from said bottom and top sides of said beam and being configured to receive one of said opposite ends of said elongated handle so as to provide a snug fitting fixed relationship between said elongated handle and said beam of each of said support bodies, mounting seats provided on and extending below said respective opposite end portions at said bottom side of said beam of each of said support bodies, said mounting seats comprising sockets affixed on and extending below said bottom side of said beam of each of said support bodies at said opposite end portions thereof, each socket having a hollow cylindrical configuration and a lower open end, and sleeves having spherical configurations with opposite top and bottom truncated ends, said sleeves having outside diameters matched with inside diameters of said sockets such that each of said sleeves snugly fits through said lower open end and into one of said sockets and contacts at said top truncated end of said sleeve with said bottom side of said beam of each of said support bodies at each of said opposite end portions thereof; and rollers each having an outside diameter matching an inside diameter of one of said sleeves of said mounting seats such that each of said rollers snugly fits with one of said sleeves, said bottom side of said beam of each of said support bodies at each of said opposite end portions thereof has a concave depression defined thereon being centered relative to one of said sockets and with a portion of one of said rollers protruding from said top truncated end of said sleeve also protruding into said respective concave depression, said sleeves having substantially frictionless inside surfaces and protrude from said lower open ends of said sockets with said rollers protruding from said bottom truncated ends of said sleeves so as to enable free wheeling rotation of said rollers in said sleeves and in contact with a support surface, thereby adapting said support bodies to be freely rolled by said rollers across said support surface as a user gripping said elongated handle performs exercises and supports a portion of a body weight of the user on said elongated handle;

also wherein said connections are provided respectively in and extending between said opposite ends of said elongated handle and said middle portion of said beam of each of said support bodies so as to retain said elongated handle and said beam of each of said support bodies in said secured snug fitting fixed relationship with respect to each other, said connections comprising first bores threadably formed in at least opposite end portions of said elongated handle so as to extend through said opposite ends of said elongated handle in coaxial alignment with said longitudinal axis of said elongated handle, second bores formed in said middle portions of said beams of said support bodies so as to extend between said recessed cavities and said outer sides of said beams of said support bodies and align with said first bores of said elongated handle in coaxial alignment with said longitudinal axis of said elongated handle, and fasteners inserted through said second bores of said beams of said support bodies and threaded into said first bores of said elongated handle in coaxial alignment with said longitudinal axis of said elongated handle so as to securely connect said elongated handle to said beams of said support bodies.

20. The device of claim 19 wherein said single units are interchangeable with one another with respect to their relationships to said opposite ends of said elongated handle.

* * * * *